US007714521B2

(12) United States Patent
Qian

(10) Patent No.: US 7,714,521 B2
(45) Date of Patent: May 11, 2010

(54) METHODS AND SYSTEM FOR CONTROLLING AN ILLUMINATING APPARATUS

(75) Inventor: Xuecheng Qian, Shanghai (CN)
(73) Assignee: Koninklijke Philips Electronics N.V., Eindhoven (NL)

( * ) Notice: Subject to any disclaimer, the term of this patent is extended or adjusted under 35 U.S.C. 154(b) by 1086 days.

(21) Appl. No.: 10/572,846

(22) PCT Filed: Sep. 21, 2004

(86) PCT No.: PCT/IB2004/051807

§ 371 (c)(1),
(2), (4) Date: Mar. 21, 2006

(87) PCT Pub. No.: WO2005/029454

PCT Pub. Date: Mar. 31, 2005

(65) Prior Publication Data

US 2006/0291199 A1 Dec. 28, 2006

(30) Foreign Application Priority Data

Sep. 24, 2003 (CN) ..... 03 1 60351

(51) Int. Cl.
*H05B 37/00* (2006.01)

(52) U.S. Cl. ..... 315/312; 315/149; 315/158; 315/307; 315/362; 345/207; 345/690

(58) Field of Classification Search ..... 315/149, 315/158, 291, 307, 308, 312, 320, 360, 362; 345/63, 101, 102, 104, 207, 211, 690
See application file for complete search history.

(56) References Cited

U.S. PATENT DOCUMENTS 5,363,223 A 11/1994 Beesley
5,406,305 A 4/1995 Shimomura et al.
5,554,912 A 9/1996 Thayer et al.
5,760,760 A 6/1998 Helms
5,907,222 A * 5/1999 Lengyel et al. ..... 315/158
6,271,813 B1 8/2001 Palalau
6,396,466 B1 5/2002 Pross et al.
2001/0006390 A1 7/2001 Tanabe
2001/0013854 A1 8/2001 Ogoro
2002/0109664 A1 * 8/2002 Shimada ..... 345/102
2002/0196854 A1 12/2002 Kim

FOREIGN PATENT DOCUMENTS

EP 1227642 A1 7/2002
EP 1320245 A1 6/2003
GB 2365691 A 2/2002
WO 0041378 A1 7/2000

* cited by examiner

*Primary Examiner*—Haissa Philogene

(57) ABSTRACT

This invention provides an improved digital luminance controlling system, which can control the luminous intensity of an illuminating apparatus by choosing the number of the ignited luminaries. It optimizes the number of the ignited luminaries according to the different contribution rate of each luminary to the general luminous intensity to reduce the power consumption. By properly adjusting the sampling frequency of the luminous intensity of the circumstance, this invention could decrease the operating frequency of the luminance controlling system, thereby to further reduce the power consumption. This invention also provides a analog type of the luminance controlling system, which consists of a optical sensing apparatus, a analog type of the luminance controlling apparatus and a set of optical source and can realize a real time luminance adjustment, to reduce the power consumption.

10 Claims, 7 Drawing Sheets

METHODS AND SYSTEM FOR CONTROLLING AN ILLUMINATING APPARATUS

FIELD OF THE INVENTION

The present invention relates to a luminance controlling system, particularly to an adaptive system that could automatically adjust its own luminous intensity according to the luminous intensity of a circumstance. As used herein, the term "circumstance" refers to ambient light as sensed by the system.

BACKGROUND OF THE INVENTION

Electronic devices such as mobile phone, PDA (Personal Digital Assistant), pager, etc. usually have a display screen, which is mostly a liquid crystal displaying apparatus that could make the content to be displayed visible by providing backlights when the luminous intensity of the circumstance is not high enough. Meanwhile, these electronic devices such as mobile phone and PDA (Personal Digital Assistant) may also have a data inputting apparatus comprising a set of keys, and the devices make the keypad visible through backlights when the luminous intensity of the circumstance is not high enough.

FIG. 1 is the prior art digital luminance controlling system. The system is a technical solution disclosed in the U.S. Pat. No. 5,760,760 (granted on Jun. 2, 1998), comprising a light sensing apparatus 110, a digital luminance controlling apparatus 120, a light source controlling apparatus 130 and a group of light sources 140, with the digital luminance controlling apparatus further comprising an analog-to-digital converter (ADC) 122, a digital signal processor (DSP) 124 and a memory 126. When the light sensing apparatus 110 detects the luminous intensity of the circumstance, it sends an signal of the luminous intensity of the circumstance to the digital luminance controlling apparatus 120, and the analog signal is converted into digital signal in accordance with a preset sampling frequency by the analog-to-digital converter 122 and the digital signal is sent to the digital signal processor 124, and the digital signal processor 124 reads the luminance level in the memory 126 according to the digital luminous intensity signal and converts it into a luminance controlling signal to be sent to the light control device 130 which adjusts the luminance of the light source according to the received luminance controlling signal.

FIG. 2 is the light source controlling apparatus of the prior art digital luminance controlling system. The device is a technical solution disclosed in the British Patent GB2, 365, 691 (published on Feb. 20, 2002), comprising a group of selection switches ($S_1, S_2, \ldots, S_N$) and M groups of resistors ($R_{11}, R_{12}, \ldots, R_{1N}; R_{21}, R_{22}, \ldots, R_{2N}; \ldots; R_{M1}, R_{M2}, \ldots, R_{MN}$), with the number of resistors in each group of resistors depending on the number of selection switches, i.e., on the number of luminance levels. The group of selection switches and M groups of resistors are connected to a light source, i.e., an illuminating apparatus comprising a group of luminaries ($L_1, L_2, \ldots, L_M$) (such as light-emitting diodes), in such a manner that each switch, such as $S_1$, is connected to a group of resistors ($R_{11}, R_{21}, \ldots, R_{M1}$) and the luminaries ($L_1, L_2, \ldots, L_M$), wherein the number of resistors in the group of resistors depends on the number of the luminaries, and wherein the resistors are directly connected to the luminaries. By setting different switches to the connection state, the currents through the luminaries or the voltages applied to the luminaries are made different, thereby, the luminance of the luminaries is adjusted.

Since the number of luminance levels in the prior art is limited by the number of the selection switches, with the increasing of luminance levels, the number of selection switches and the number of the groups of the resistors increase simultaneously, thus the selection of the number of luminance levels is obviously limited while the corresponding cost increases. Therefore, the object of reducing power consumption by changing the luminance more smoothly with the change of the luminous intensity of the circumstance cannot be achieved.

Hence, an improved luminance controlling system is needed, which could change the luminance more smoothly with the change of the luminous intensity of the circumstance so as to achieve the objects of reducing power consumption and saving cost.

SUMMARY OF THE INVENTION

The present invention provides an improved digital luminance controlling system, in a light source controlling apparatus thereof, the resistor and the luminaries are connected by a switch, thus the luminance of the illuminated area could be controlled by selecting the number of the ignited luminaries. By reducing the number of the ignited luminaries, the power consumption could be reduced.

The present invention further provides an improved digital luminance controlling system, and a digital luminance controlling apparatus thereof compares two successively detected values of the luminous intensity of the circumstance. If the difference between the values is smaller than a predetermined value, the sampling frequency is decreased, and if the difference is greater than another predetermined value, the sampling frequency is increased. By adjusting the sampling frequency timely, the luminance controlling system could operate less frequently and thereby the power consumption could be reduced.

The present invention further provides an analog luminance controlling system, comprising a light sensing apparatus, an analog luminance controlling apparatus and a group of light sources. When the light sensing apparatus detects the luminous intensity of the circumstance, it sends an signal of the luminous intensity of the circumstance to the analog luminance controlling apparatus, and the signal of the luminous intensity of the circumstance is converted into luminance controlling signal according to a preset magnification by the analog luminance controlling apparatus, and the controlling signal is applied to the light source in the form of current or voltage to adjust the luminance of the light source. Since the luminance controlling apparatus works in an analog manner, real-time luminance adjustment could be realized, and thus the power consumption is reduced. Meanwhile, since the analog-to-digital converter (ADC), the digital signal processor (DSP), the memory and the light source controlling apparatus are not needed any more, the objects of saving costs and further reducing power consumption can be achieved.

The other objects and achievements of the present invention will be obvious by referring to the following descriptions made with reference to the figures and the claims which will be helpful for better understanding of the present invention.

DESCRIPTION OF THE DRAWINGS

The present invention is explained in detail in the form of embodiments with reference to the figures, wherein.

In all the figures, the same reference numerals indicate the same or similar features and functions.

DETAILED DESCRIPTION OF THE PREFERRED EMBODIMENTS

Figure 1:
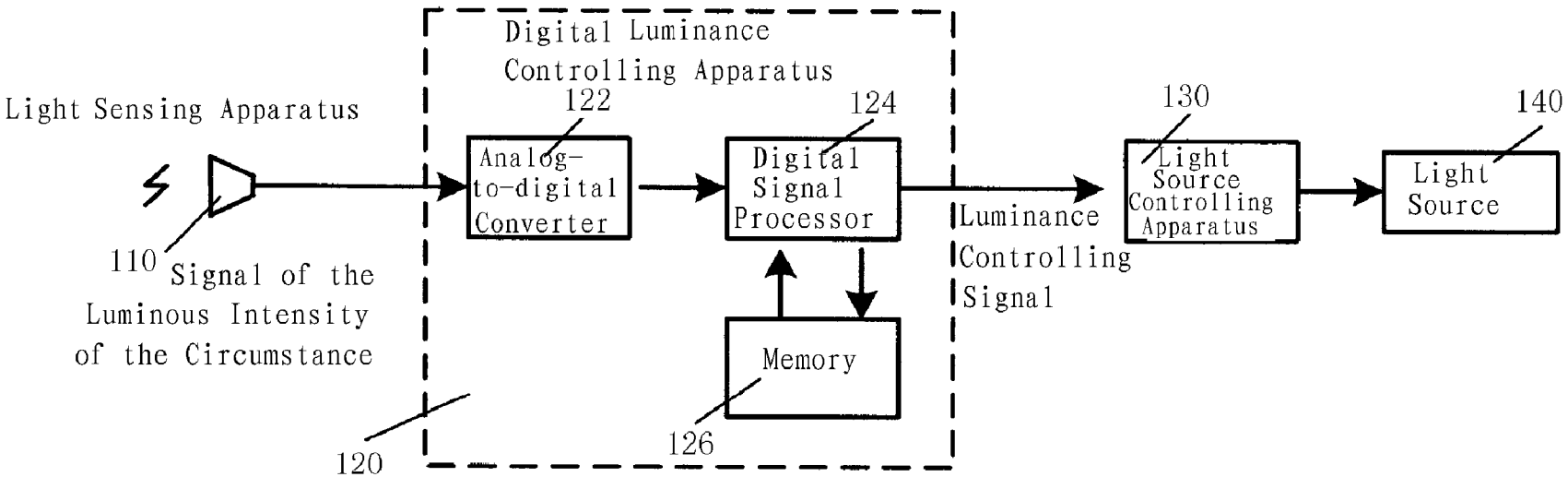
FIG. 1 Prior Art
FIG. 1 is the prior art digital luminance controlling system.
Figure 2:
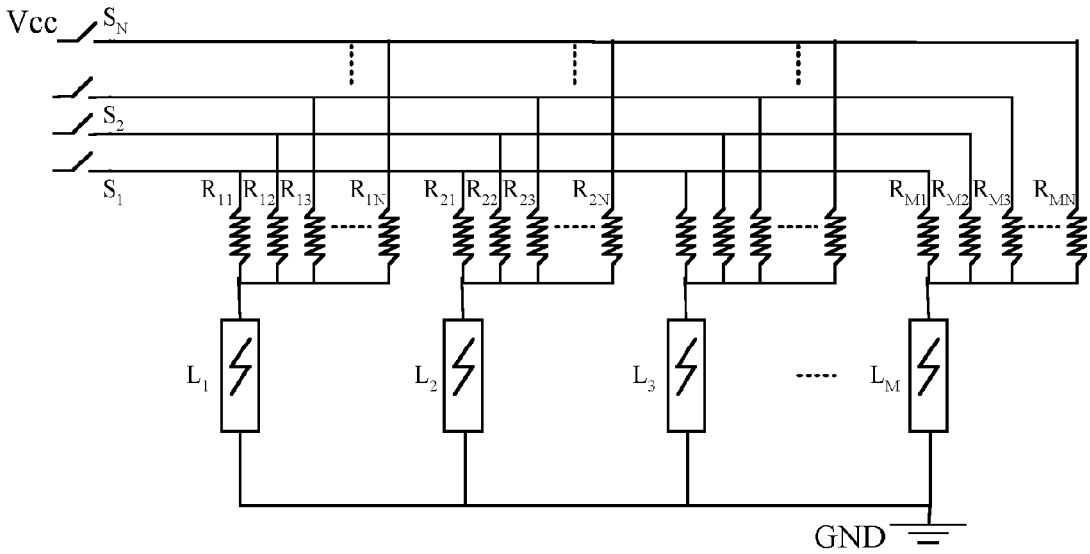
FIG. 2 Prior Art
FIG. 2 is the light source controlling apparatus of the prior art digital luminance controlling system.
Figure 3:
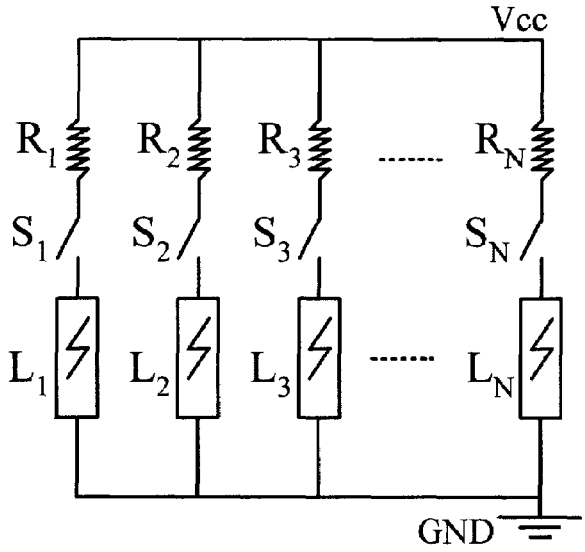
FIG. 3 is the digital luminance controlling apparatus of an embodiment of the present invention.

FIG. 3 is the digital luminance controlling apparatus of an embodiment of the present invention. In the figure, a group of selection switches ($S_1, S_2, \ldots, S_N$) is connected between the resistors ($R_1, R_2, \ldots, R_N$) and the luminaries ($L_1, L_2, \ldots, L_N$) that compose the illuminating apparatus, and a corresponding number of luminaries can be set to the ignited state by setting different numbers of switches to the connection state, and thereby to make the light source comprising the group of luminaries provide the desired luminance in the illuminated area. Compared with the prior art technical solution as shown in FIG. 2, the embodiment could greatly reduce the number of resistors needed and the complexity of the circuits while maintaining the same luminance controlling level, thus the power consumption is reduced.

Figure 4:
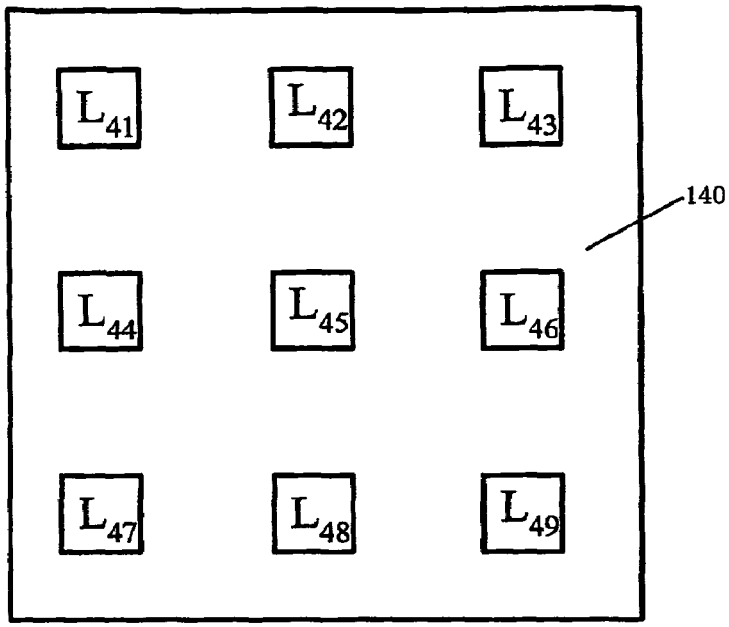
FIG. 4 is the schematic plan view of a group of luminaries composing the illuminating apparatus of an embodiment of the present invention.

FIG. 4 is the schematic plan view of a group of luminaries composing the illuminating apparatus of an embodiment of the present invention. In the area that needs to be illuminated, there is an illuminating apparatus comprising a group of nine luminaries ($L_{41}, L_{42}, \ldots, L_{49}$), and the arrangement of the luminaries is shown in the figure. It can be seen from the figure that luminaries in different positions contribute differently to the general luminous intensity of the illuminated area under the same illuminating conditions (the same rated power, the same current, etc.), for example, $L_{45}$ contributes more than $L_{44}$, and $L_{44}$ contributes more than $L_{41}$ and so on. Thus it is possible to select the least number of luminaries that are in the ignited state by using a particular algorithm according to the different contribution rates of each luminaries to the general luminous intensity of the illuminating apparatus so as to achieve the desired general luminous intensity, thus the power consumption is reduced. For instance, under the same illuminating conditions, the light source comprising $L_{42}+L_{44}+L_{46}+L_{48}$ could achieve the same general luminous intensity as the light source comprising $L_{41}+L_{43}+L_{45}+L_{47}+L_{49}$.

Furthermore, luminaries of different rated illuminating power could be selected according to the different contribution rate of each luminary to the general luminous intensity, and resistors of different resistance values could be selected to be connected to different luminaries, thereby, different luminaries could have different luminous intensity under the same luminance controlling signal.

In addition, some electronic devices, such as mobile phone, PDA (Personal Digital Assistant) etc., may have a display screen and a data inputting apparatus comprising a set of keys, and in the same surrounding environment, the luminous intensity of the illuminating apparatus under the control of the luminance controlling apparatus could be different in the display screen and in the area of data inputting apparatus, and thus the power consumption is further reduced.

Figure 5:
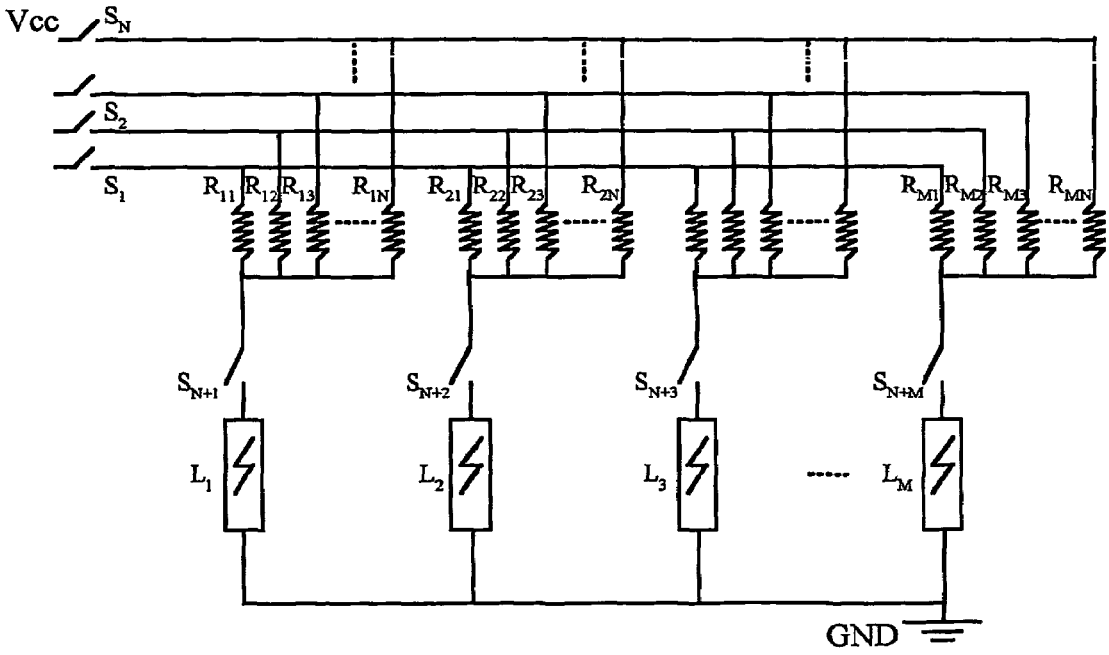
FIG. 5 is a digital luminance controlling apparatus of another embodiment of the present invention.

FIG. 5 is a digital luminance controlling apparatus of another embodiment of the present invention, the digital luminance controlling apparatus is an improvement based on the technical solution of FIG. 3. On the basis of the technical solution of FIG. 2, a group of switches ($S_{N+1}, S_{N+2}, \ldots, S_{N+M}$) is added between M groups of resistors ($R_{11}, R_{12}, \ldots, R_{1N}$; $R_{21}, R_{22}, \ldots, R_{2N}; \ldots; R_{M1}, R_{M2}, \ldots R_{MN}$) and luminaries ($L_1, L_2, \ldots, L_M$), thus compared with the technical solution of FIG. 2, the present embodiment could have more luminance controlling levels available for selection, so that the luminance could be changed more smoothly with the change of the luminous intensity of the circumstance so as to achieve the object of reducing power consumption.

Figure 6:
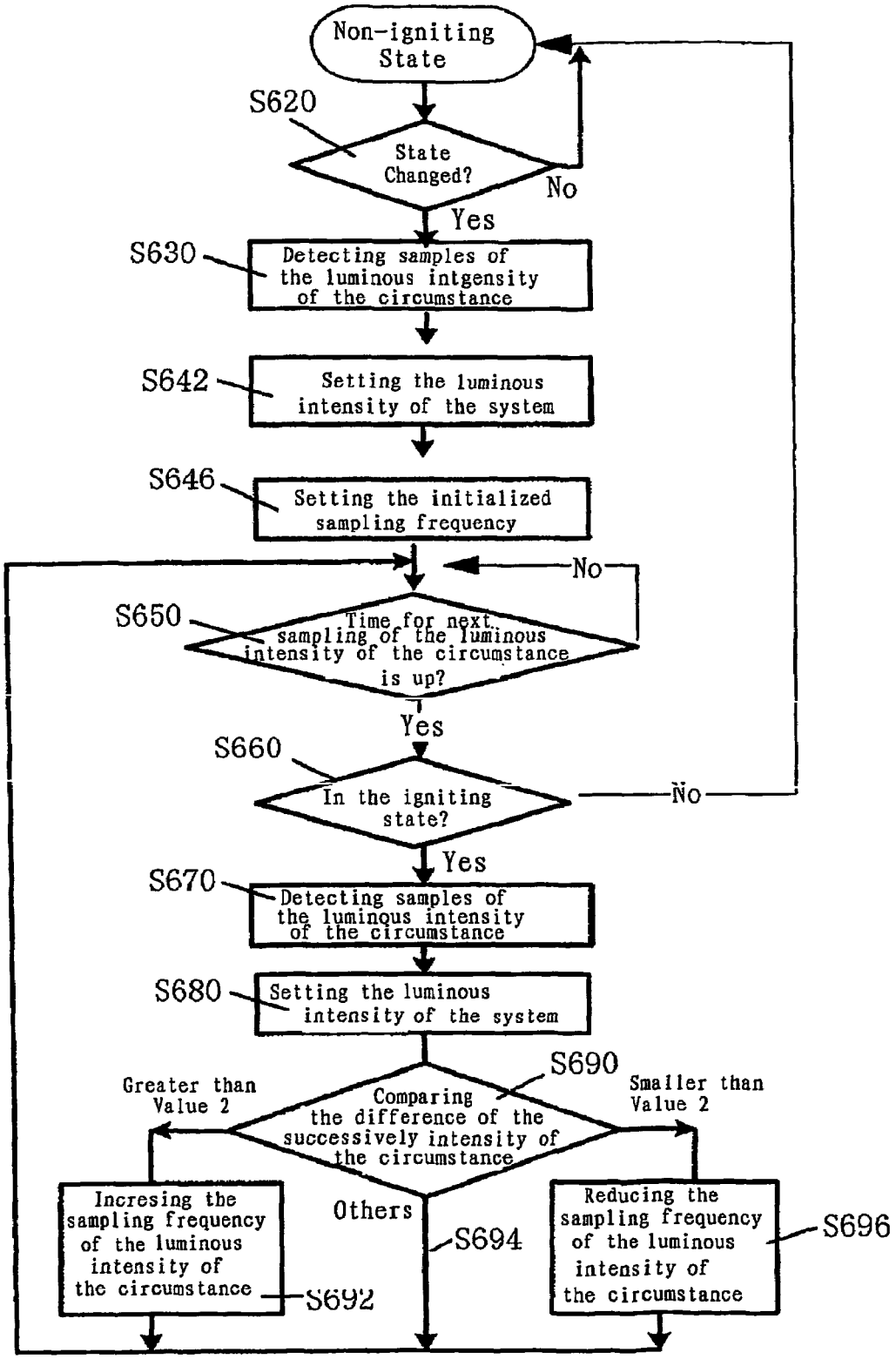
FIG. 6 is the flow chart of the operating process of the digital luminance controlling system of an embodiment of the present invention.

FIG. 6 is the flow chart of the operating process of the digital luminance controlling system of an embodiment of the present invention. The display screens of electronic devices such as mobile phone, PDA (Personal Digital Assistant) have different states. In the present embodiment, there are two different types of states, i.e., the igniting state and the non-igniting state, wherein the igniting state is the working state that needs manual intervention and the non-igniting state includes the stand-by state and working state that does not need manual intervention, etc. The working state that does not need manual intervention is, for example, the state of data exchanging with the computer or network and the state of calling for a long time, etc.

The electronic devices are usually in the non-igniting state, and when the state changes to an igniting one (step S620), the luminance controlling system first detects the luminous intensity of the circumstance (step S630) and then preliminarily sets the luminous intensity of the illuminating apparatus of the system according to the luminous intensity of the circumstance (step S642) while initializing the luminous intensity of the circumstance sampling frequency (step S646). In step S642, the luminous intensity of the illuminating apparatus of the system could be set to zero according to the luminous intensity of the circumstance, i.e., not using the illuminating apparatus of the system.

Afterward, when the next sampling time is up (step S650), it is determined whether the electronic device is in the igniting state (step S660). If it is, again the luminance controlling system detects the luminous intensity of the circumstance (step S670) and sets the luminous intensity of the illuminating apparatus of the system according to the luminous intensity of the circumstance (step S680), and if it is not in the igniting state, the whole system is set to the non-igniting state.

When the sampling has been performed twice or more, each new sampled value of the luminous intensity of the circumstance is compared with its previous sampled value of the luminous intensity of the circumstance (step S690). If the absolute value of the difference is smaller than a certain preset value Value 1 (e.g., 2 lux), the sampling frequency of the luminous intensity of the circumstance is reduced based on the difference (step S696); if the absolute value of the difference is greater than a certain preset value Value 2 (e.g., 10 lux), the sampling frequency of the luminous intensity of the circumstance is increased based on the difference (step S692), wherein Value 2>Value 1; and if the absolute value of the difference is between the preset value Value1 and Value2, the sampling frequency of the luminous intensity of the circumstance remains the same (step S694).

In the end, return to step S650 according to the adjusted sampling frequency of the luminous intensity of the circumstance. When the next sampling time is up, it is determined again whether the electronic device is in the igniting state, and the above process will be repeated.

Figure 7A:
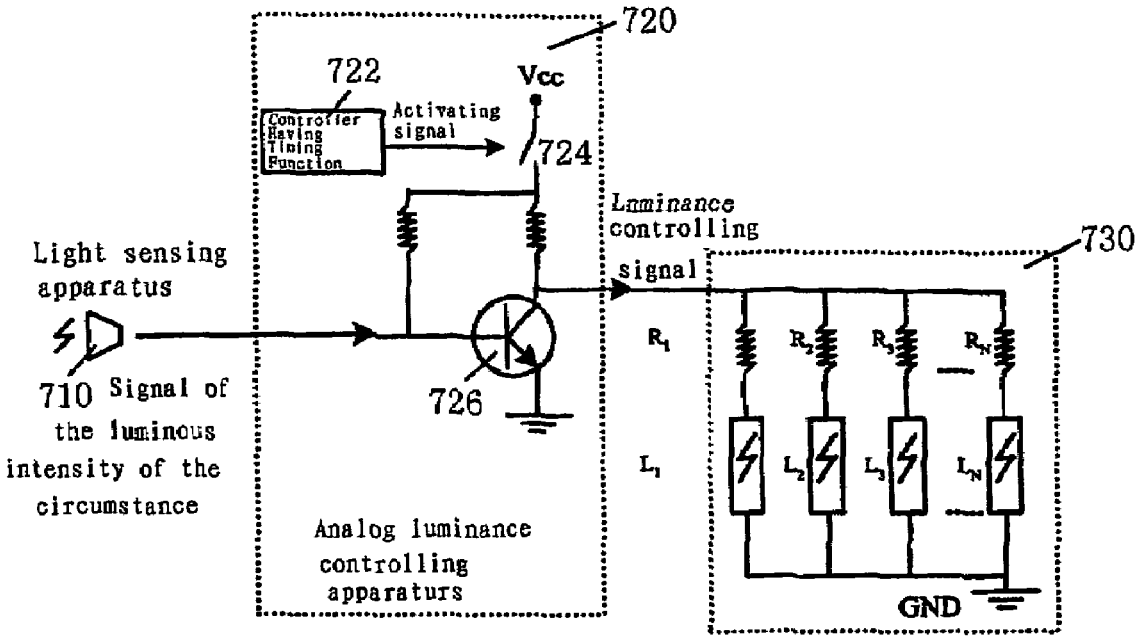
FIGS. 7A and 7B are the analog luminance controlling system of an embodiment of the present invention.
Figure 7B:
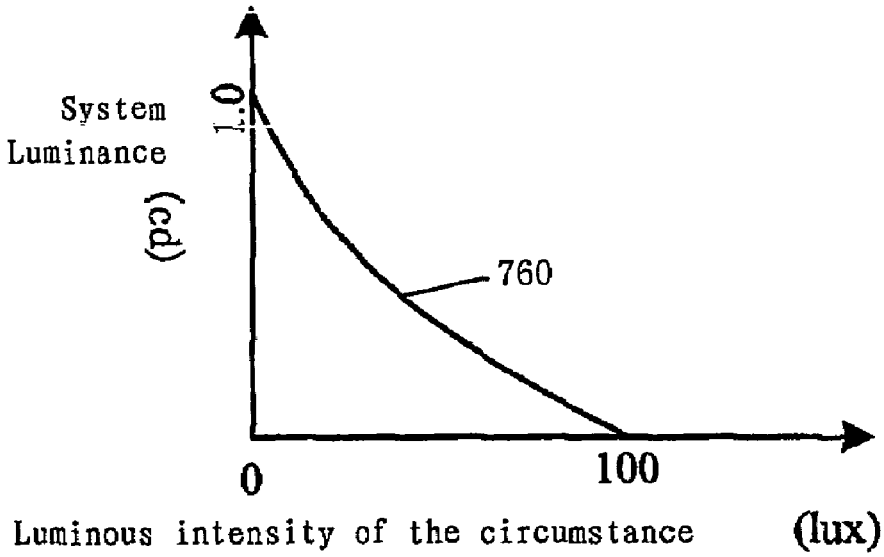

FIG. 7 is the analog luminance controlling system of an embodiment of the present invention. The analog luminance controlling system comprises a light sensing apparatus 710, an analog luminance controlling apparatus 720 and a group of light sources 730. The analog luminance controlling apparatus further comprises a mapping amplifying circuit 726, a controller 722 with timing function and a switch 724.

When the light sensing apparatus 710 detects the luminous intensity of the circumstance, it sends a signal of the luminous intensity of the circumstance to the analog luminance controlling apparatus 720. When the electronic device employing the analog luminance controlling system is in an igniting state, the controller 722 with timing function sends an activating signal to set the switch 724 to the connection state, then the signal of the luminous intensity of the circumstance is converted into luminance controlling signal according to the preset reverse magnification by the analog luminance controlling apparatus and the controlling signal is applied to the light source in the form of current or voltage to adjust the luminance of the light source.

The reverse magnification of the present embodiment is shown in the curve 760 of the figure. The curve is continuously changed in real-time while the higher the luminous intensity of the circumstance is, the lower the luminous intensity of the system itself. The reverse magnification could be preset by the manufacturer of the electronic device or by the user. The luminance controlling system having an reverse relationship with the luminous intensity of the circumstance could be applied to electronic devices providing backlights, such as the liquid crystal display screen of the mobile phone, etc., wherein the higher the luminous intensity of the circumstance is, the lower the backlights intensity of the display screen. When the luminous intensity of the circumstance is greater than 100 lux, the backlights intensity of the display screen is zero, i.e., the illuminating apparatus of the system is not in use.

Accordingly, in the preceding digital luminance controlling system, the luminance controlling signal sent by the digital luminance controlling apparatus and the luminous intensity of the circumstance could also have a reverse relationship, and the reverse relationship could also be preset by the manufacturer of the electronic device or by the user, except that it is a non-continuous grading distribution.

As for the analog luminance controlling system, luminaries of different rated illuminating power could be selected according to different contribution rate of each luminary to the general luminous intensity of the illuminated area. Resistors of different values could also be selected to be connected to different luminaries, and thereby different luminaries could have different luminous intensity under the same luminance controlling signal.

In addition, some electronic devices, such as mobile phones, PDA (Personal Digital Assistant), etc., have a display screen and a data inputting apparatus comprising a set of keys. The luminous intensity of the light source under the control of the luminance controlling apparatus could be different in the display screen and in the area of data inputting apparatus while they are in the same environment, and thus the power consumption is further reduced.

Figure 8A:
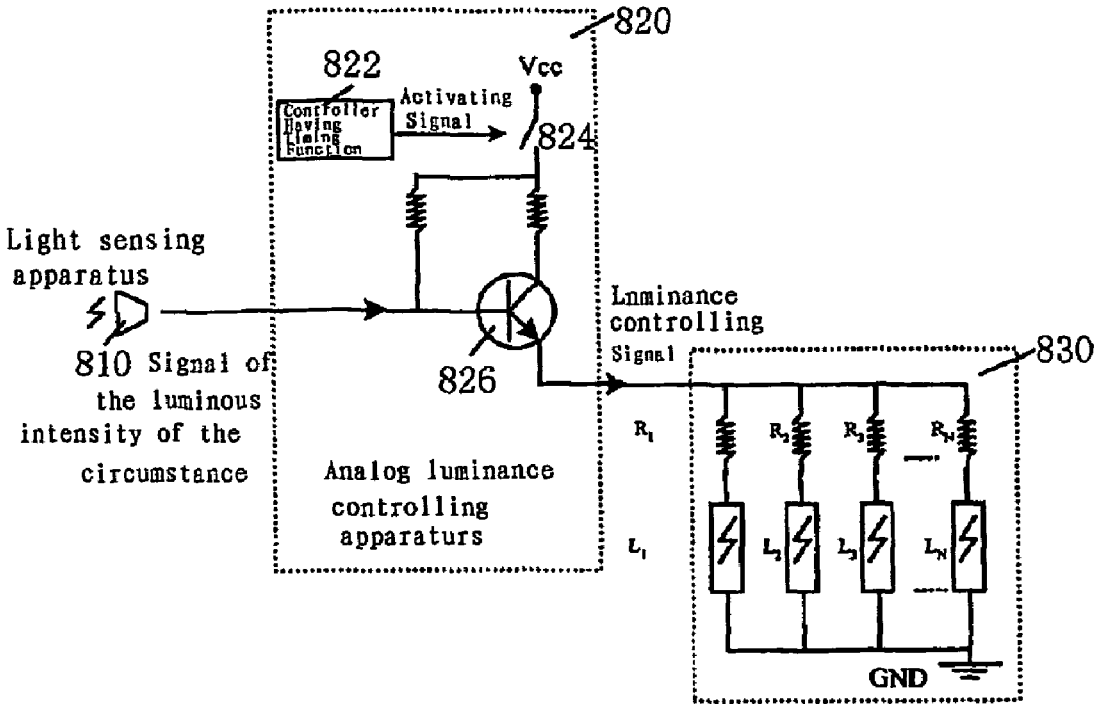
FIGS. 8A and 8B are the analog luminance controlling system of another embodiment of the present invention.
Figure 8B:
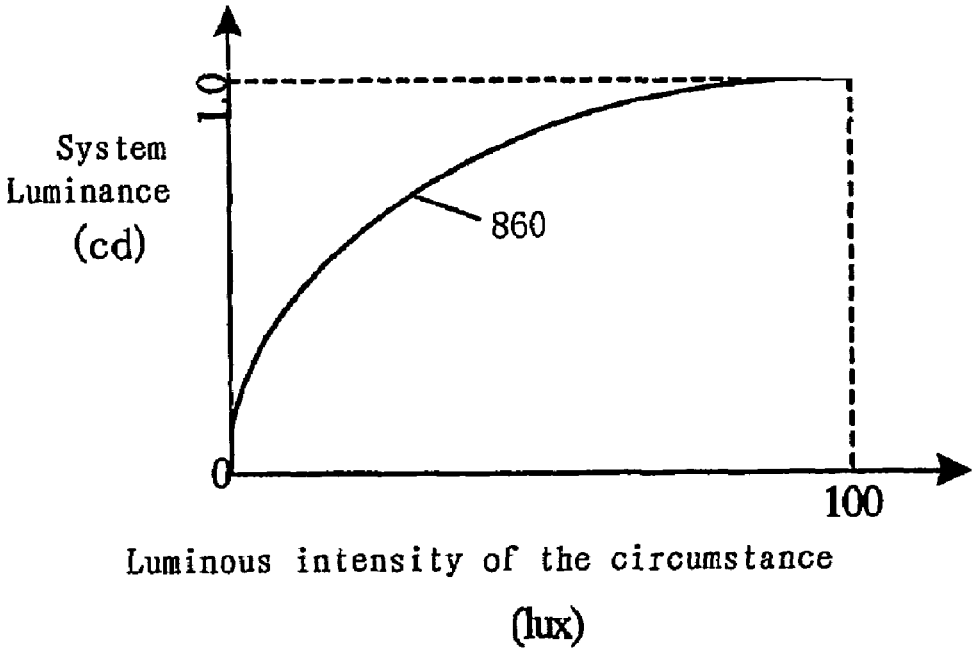

FIG. 8 is the analog luminance controlling system of another embodiment of the present invention. The system differs from the analog luminance controlling system of the embodiment in FIG. 7 by that the analog luminance controlling apparatus 820 mapping amplifies the signal of the luminous intensity of the circumstance into the luminance controlling signal according to the preset positive magnification and applies it to the light source 830 in the form of current or voltage to adjust the luminance of the light source.

The positive magnification of the present embodiment is shown as curve 860 in the figure. The curve is continuously changed in real-time while the higher the luminous intensity of the circumstance is, the higher the luminous intensity of the system itself. The positive magnification could be preset by the manufacturer of the electronic device or by the user. The luminance controlling system having a positive relationship with the luminous intensity of the circumstance could be applied to self-illuminating electronic devices, such as traffic lights on the roads, wherein the higher the luminous intensity of the circumstance is, the higher the luminous intensity of the traffic lights so as to facilitate recognition.

Accordingly, in the preceding digital luminance controlling system, the luminance controlling signal sent by the digital luminance controlling apparatus and the luminous intensity of the circumstance could also have positive relationship, and the positive relationship could also be preset by the manufacturer of the electronic device or by the user, except that it is a non-continuous grading distribution.

Figure 9:
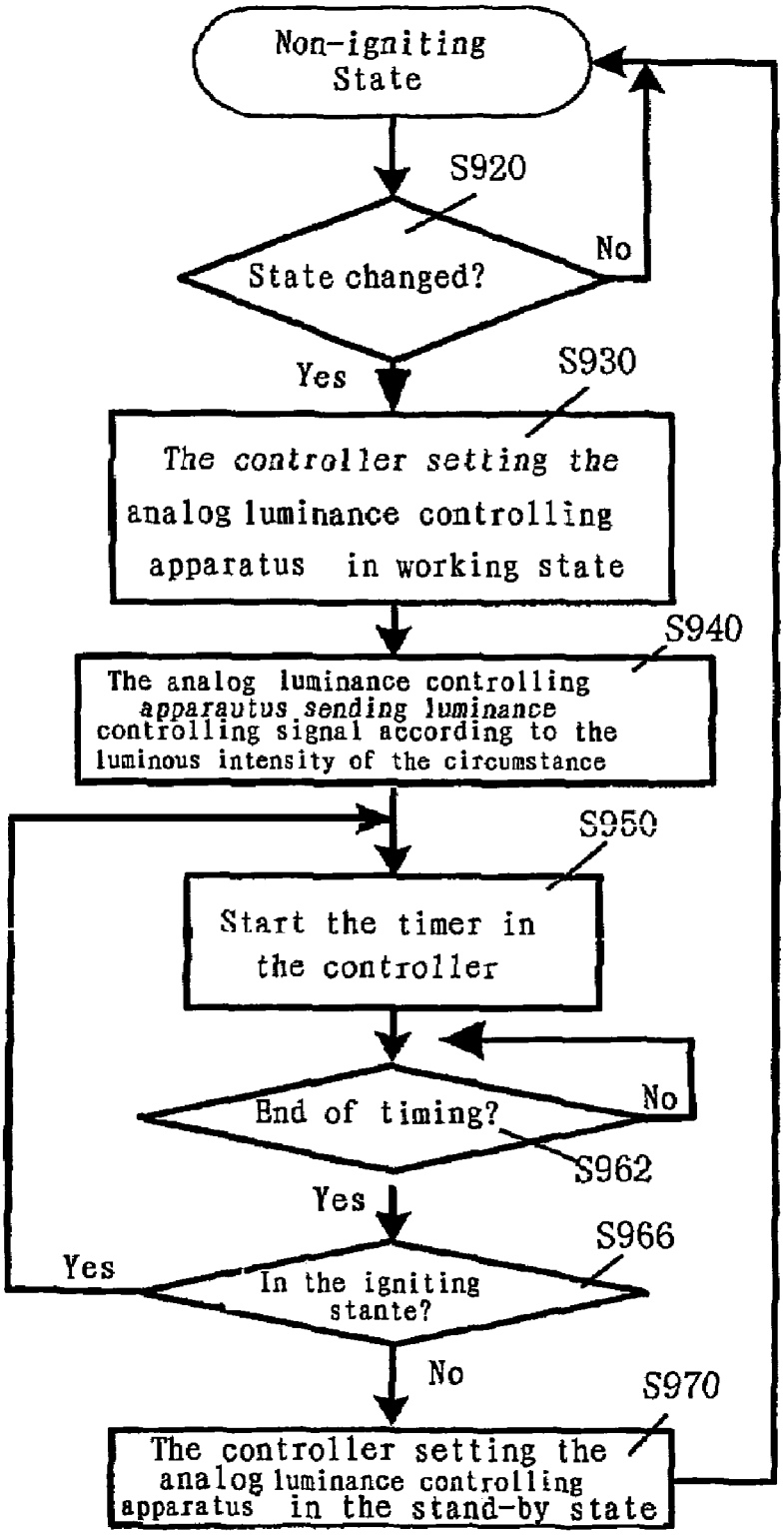
FIG. 9 is the flow chart of the operating process of the analog luminance controlling system of an embodiment of the present invention.

FIG. 9 is the flow chart of the operating process of the analog luminance controlling system of an embodiment of the present invention. Electronic devices are usually in the non-igniting state, and when the state changes to an igniting one (step S920), the controller with timing function sets the switch to the connection state to set the luminance controlling apparatus to the working state (step S930). At this point, the system sends luminance controlling signal according to the detected luminous intensity of the circumstance, and the luminance controlling signal could adjust the luminous intensity of the illuminating apparatus (step S940). In step S940, the luminous intensity of the illuminating apparatus of the system could be set to zero according to the luminous intensity of the circumstance, i.e., not using the illuminating apparatus of the system.

Subsequently, the timer in the controller is set to the working state (step S950). When the timing is over, i.e., when the next detection time is up (step S962), it is determined whether the electronic device is in the igniting state (step S966). If so, return to step 950 to repeat the process until the electronic device is in the non-igniting state. If not, the controller sets the analog luminance controlling apparatus to a stand-by state (step S970) and then returns to step S910. The duration in which the timer of the controller is in the working state is preset by the manufacturer of the electronic device or by the user.

Although the present invention has been described in detail with reference to the embodiments, it is obvious for those skilled in the art to make substitutions, modifications and variations on the basis of the above descriptions. Therefore, if such substitutions, modifications and variations should fall into the spirit and scope of the appended claims, they should be included in the present invention.

What is claimed is:

1. A system for controlling an illuminating apparatus comprising a plurality of luminaries, the system comprising:

a sensing apparatus for sensing the luminous intensity of a circumstance; and a light source controlling apparatus for controlling the luminous intensity of said illuminating apparatus, wherein:

each luminary of said plurality of luminaries has a predetermined luminance output, said sensing apparatus samples the luminous intensity of the circumstance and communicates a signal associated with a value of said luminous intensity to said light source controlling apparatus, and said light source controlling apparatus activates a number of luminaries of the plurality of luminaries based at least in part on said value of the luminous intensity.

2. The system according to claim 1, wherein said light source controlling apparatus activates said number of luminaries based on a contribution of each of said luminaries to a general luminous intensity of said illuminating apparatus.

3. The system according to claim 1, wherein said sensing apparatus adjusts a sampling frequency according to a change in said luminous intensity of the circumstance.

4. The system according to claim 1, wherein each of said multiple luminaries has at least two predetermined luminance outputs and said light source controlling apparatus activates one of said predetermined luminance outputs corresponding to said luminous intensity of the circumstance.

5. A method for controlling the illuminating apparatus comprising a plurality of luminaries comprising the steps of:

sampling a luminous intensity of a circumstance;

generating a control signal associated with a sampled value of said luminous intensity; and activating a number of the luminaries of the plurality of luminaries based at least in part on said control signal.

6. The method according to claim 5, further comprising the step of selecting said number of the luminaries based on a contribution of each of said luminaries to a general luminous intensity of said illuminating apparatus.

7. The method according to claim 5, wherein a frequency of said sampling is adjusted based on a change in said luminous intensity of the circumstance.

8. The method according to claim 5, wherein each of said multiple luminaries has at least two predetermined luminance outputs, the method further comprising the step of activating one of said predetermined luminance outputs corresponding to said circumstance luminous intensity.

9. A system for controlling an illuminating apparatus incorporating at least one luminary comprising:

a sensing apparatus; and a light source controlling apparatus;

wherein said luminary has a predetermined luminance output at a predetermined power consumption, said sensing apparatus communicates to said light source controlling apparatus an analog signal corresponding to a luminous intensity of a circumstance, and said light source controlling apparatus adjusts the power consumption based at least in part on said analog signal.

10. The system according to claim 9, wherein said light source controlling apparatus adjusts the power consumption corresponding to said analog signal by regulating an electric current affecting said luminary.

* * * * *